United States Patent [19]

Schaerer

[11] Patent Number: 4,603,799

[45] Date of Patent: Aug. 5, 1986

[54] FORWARD FEED ASSEMBLY FOR CONTINUOUS FORWARD FEED OF OPEN TUBULAR FABRIC UNDER CONTROLLED TENSION

[76] Inventor: Jean E. Schaerer, Apartment 243, 800 Clark Blvd., Bramalea, Ontario, Canada, L6T, 2E8

[21] Appl. No.: 685,020

[22] Filed: Dec. 21, 1984

[30] Foreign Application Priority Data

Dec. 30, 1983 [CH] Switzerland ..... 6983/83

[51] Int. Cl.[4] ..... B65H 20/02; B65H 20/06

[52] U.S. Cl. ..... 226/171

[58] Field of Search ..... 226/171, 172, 170; 156/156, 428, 431, 175

[56] References Cited

U.S. PATENT DOCUMENTS 3,100,070 8/1963 Smith ..... 226/171
3,250,654 5/1966 Rubenstein ..... 156/428 X
3,281,299 10/1966 Shobert ..... 156/175
3,490,973 1/1970 Graff et al. ..... 156/156
3,506,522 4/1970 Onifer, Jr. et al. ..... 156/428 X

FOREIGN PATENT DOCUMENTS 1149841 1/1958 France ..... 226/171

*Primary Examiner*—Stuart S. Levy
*Assistant Examiner*—Lynn M. Sohacki
*Attorney, Agent, or Firm*—Robert F. Delbridge; Arne I. Fors

[57] ABSTRACT

A forward feed assembly for continuous forward feed of open tubular fabric to a subsequent processing station has an elongated guide mandrel over which the open tubular fabric passes, a first drive on one side of the guide mandrel operable to drivingly engage the fabric, and a second drive on an opposite side of the guide mandrel to drivingly engage the fabric at the same fabric-engaging speed as the first drive.

2 Claims, 3 Drawing Figures

FORWARD FEED ASSEMBLY FOR CONTINUOUS FORWARD FEED OF OPEN TUBULAR FABRIC UNDER CONTROLLED TENSION

This invention relates to forward feed assemblies for continuous forward feed of opened tubular fabric to a subsequent processing station.

Such a processing station may, for example, comprise machines for braiding, wrapping, or spinning (in the sense of extrusion), covering layers, or any other process for the wrapping or covering of textiles of tubular form. Also, the processing station may comprise pull-through processes for producing rigid or flexible tubular products.

As it is known, multilayer tubular textile products must commonly be formed in one continuous operation (in a single pass) in special multistage machines in order to maintain the specified inside dimension. The conventional process can be explained by the example of a multilayer tubular fabric. The braided hose comprising an inner casing and an outer casing and having a defined inside dimension, that is the inside diameter, must be fabricated in a two-stage tubular braiding machine. This means that both braiding heads must be mounted on the braiding axis in a fixed relationship to each other, being either one above the other or one after the other. In order to maintain the inside dimension, a calibrating mandrel (gauge plug) must be provided inside the tubular fabric to maintain the desired inside diameter. The mandrel must be continuous from the beginning of the first stage of braiding up to the braiding point in the last stage of braiding so that, in the succeeding covering braiding stages, the inner casing does not become constricted or folded.

The production method which is now in common use has the disadvantage that the individual stages of the machine must be separately built for each multilayer tubular fabric form that is continuously produced and which must have a certain specified diameter.

An object of the present invention is to provide a forward feed assembly which enables a prefabricated textile tube to be continuously fed forward to subsequent processing stages while maintaining its correct form and with which the location and time of the subsequent stages are independent of those of the preceding stage. According to the invention, this objective is attained by the design of a forward feed assembly which makes it possible to transport to subsequent processing stages different types of tubular material in the opened condition and under controlled tension.

The present invention accordingly provides a forward feed assembly for continuous forward feed of open tubular fabric to a subsequent processing station, comprising an elongated guide mandrel over which the open tubular fabric passes, first drive means on one side of the guide mandrel operable to drivingly engage the fabric, and adjacent drive means on an opposite side of the guide mandrel to drivingly engage the fabric at the same fabric-engaging speed as the first drive means.

The first drive means may comprise a pulley and the second drive means may comprise an endless belt. The guide mandrel may curve around a portion of the circumference of the pulley, with the endless belt engaging the fabric as the fabric passes around that pulley portion.

One embodiment of the invention will now be described, by way of example, with reference to the accompanying drawings, of which:

Figures 1, 2, 3:
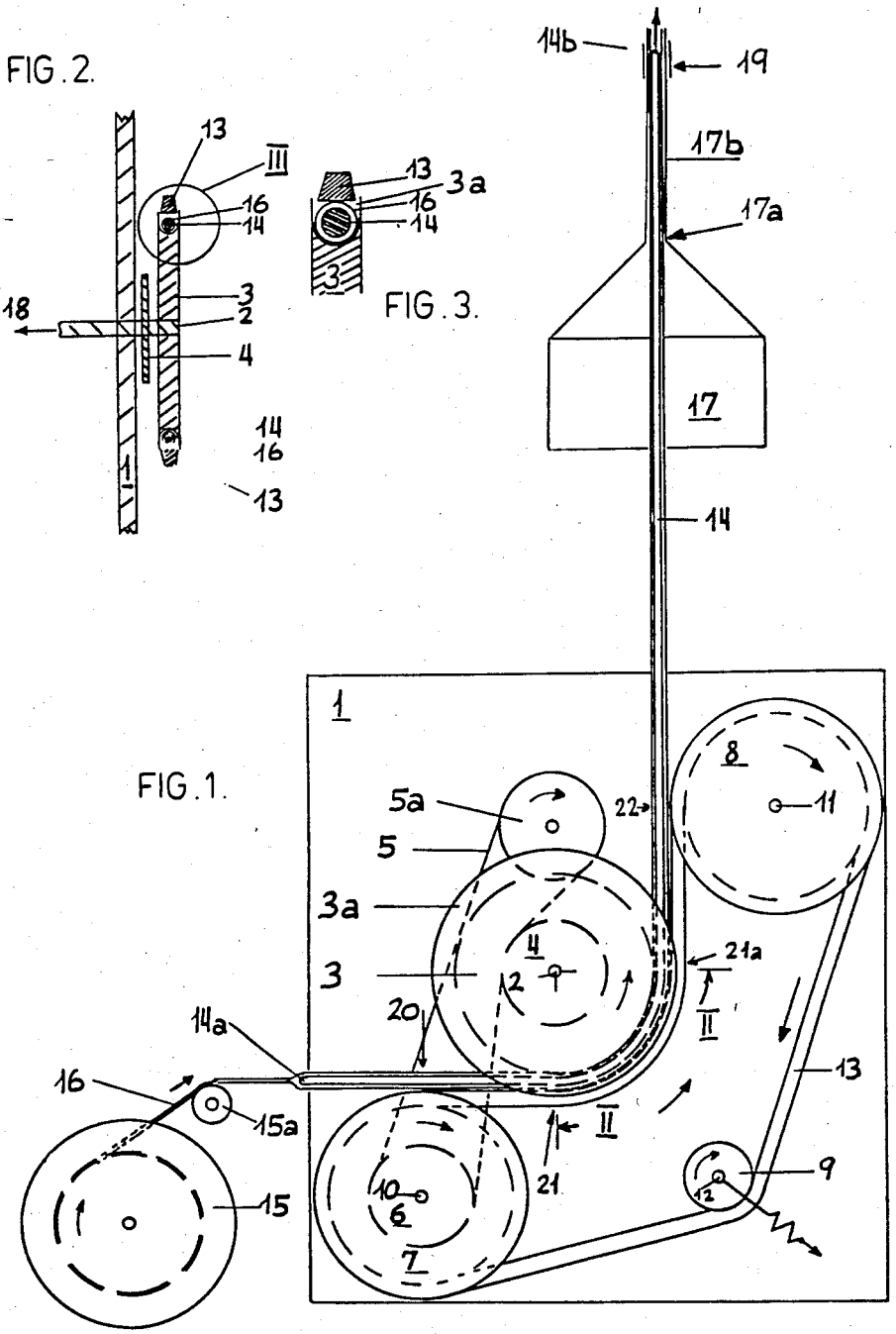
FIG. 1 is a side elevation of a forward feed assembly.
FIG. 2 is a sectional view through parts of the transport mechanism along the line II—II of FIG. 1.
FIG. 3 is an enlarged detail view of the area indicated by the numeral III in FIG. 2.

Referring to the drawings, a forward feed assembly for continuous forward feed of open tubular fabric under controlled tension has four pulleys 3, 7, 9, 8 carried by shafts 2, 10, 12, 11 respectively mounted on a baseplate 1. The shaft 2 is a drive shaft which also carries a sprocket wheel 4 for a drive chain. A chain drive assembly 4, 5, 5*a*, 6 drives the pulleys 2 and 7. A transport belt 13, which in this embodiment is a V-belt, is dimensioned to suit the tubular fabric and is wrapped around the transport pulley 7, the guide pulley 8 and the tensioning pulley 9. The belt 13 is in frictional contact with the tubular fabric 16 in the region of the angle of wrap 21 to 21*a* around the transport pulley 3.

The drive shaft 2 drives the transport pulley 3 and the chain drive comprising sprocket wheels 4, 5*a*, 6 and a roller chain 5. The drive shaft 2 is driven by a unit having a motor, reduction gearing, and a Variator (variable-speed gear).

An elongated guide mandrel 14 curves around a portion of the circumference of the drive pulley 3 in the space between the groove 3*a* in the transport pulley 3 and the back of the transport belt 13 without being attached thereto, as shown in FIGS. 2 and 3. The guide mandrel 14 may be of circular cross section or of any other selected cross section, and may be made of stainless steel, ceramic material, Teflon or Teflon-coated material for reducing the coefficient of friction, or any other suitable material. For better positioning in the groove 3*a* of the transport pulley 3*a*, the guide mandrel 14 may be stabilized locally by magnets.

The cross-sections of the transport pulley 3 and the transport belt 13 are designed relative to the profile of the guide mandrel 14 so that, for the tubular fabric 16 which is drawn over the mandrel 14, there will be frictional contact between the fabric and the transport belt 13 and between the fabric and the transport pulley 3, but not between the fabric 16 and the guide mandrel 14. It can be seen in FIG. 1 that the flattened tubular fabric 16 wound on a feed roll 15 is pulled over a deflector roll 15*a* and then onto the infeed end 14*a* of the mandrel 14. Starting at the feed-belt contact point 20, the tubular fabric 16 lies against the transport belt 13. Starting at contact point 21 the tubular fabric 16 is fed forward over the guide mandrel 14 to the next processing station 17 under the action of friction between the fabric 16 and the transport pulley groove 3*a* on one side, and between the fabric 16 and the transport belt 13 on the opposite side.

The rate of forward feed is adjusted by the motor, gear and Variator unit 18 to suit the delivery rate of the pull-through mechanism 19 in the processing station 17, which means that the tubular fabric 16 can be fed forward practically without tension and therefore in a particularly gentle way or it may be fed with some suitable amount of tension. The circumferential velocities of the transport pulley 3 and of the transport belt 13 are equal. The groove 3*a* in the transport pulley may be knurled and the surface of the transport belt 13 may be grooved and/or knurled so that the tubular fabric 16 is held positively as it is pulled over the mandrel 14. The form of the surfaces of the transport elements 3, 13 which engage the tubular fabric can be selected to give both frictional and positive gripping action.

The guide mandrel 14 may curve around the drive pulley 3 to an extent appropriate for the fabric being fed. For example, the mandrel 14 may be curved around the transport pulley 3 so as to be U-shaped instead of L-shaped. The transport belt 13 is passed around the outside of the curve in the mandrel 14 resulting in a higher frictional force.

Instead of the point of contact 21 of the fabric 16 with the mandrel 14 being before engagement with the belt 13 as shown, the contact point 21 may be at or after engagement with the belt 13.

In the present case, the processing station 17 comprises a tubular brading machine for braiding a second tubular fabric layer 17*b*. It can be clearly seen in FIG. 1 that the delivery end 14*b* of the mandrel 14 performs the function of a gauging or calibrating plug, otherwise the second layer of braided fabric 17*b* added at the braiding point 17*a* could constrict the delivered tubular fabric 16 or could even cause it to become folded.

Depending on the actual nature of the processing of the tubular fabric 16, the processing station 17 may comprise a machine for wrapping, spinning or working a second layer of fabric onto the tubular fabric. In one preferred application of forward feed mechanism in accordance with the invention, the processing station 17 is a continuous casting machine for the production of reinforced plastic hose. In the continuous production of flexible hose or of rigid hollow profiles of any form by the use of continuous drawing processes, reinforcing material of tubular textile fabric must be fed forward uniformly and concentrically. When using previous technology, such hollow profiles, which are usually cylindrical, can be manufactured only by non-continuous (batch) casting methods. Reference is made for example to U.S. Pat. No. 3,281,299 issued Oct. 25, 1966 in which the production of batch-wound and cast pipes is described. The disadvantage of such a method is evident. With such non-continuous methods, only pieces of limited length can be produced, whereas with forward feed mechanism in accordance with the invention, continuous production of hollow profiles can be effected.

Other embodiments of the invention will be readily apparent to a person skilled in the art, the scope of the invention being defined in the appended claims.

What I claim as new and desire to protect by Letters Patent of the United States is:

1. A forward feed assembly for continuous forward feed of open tubular fabric to a subsequent processing station comprising:

an elongated curved guide mandrel over which the open tubular fabric passes, pulley means on one side of the curved guide mandrel operable to drivingly engage the fabric, said guide mandrel curving through at least about 90° around a portion of the circumference of the pulley means, and endless belt drive means on an opposite side of the curved guide mandrel to drivingly engage the fabric at the same fabric engaging speed as the pulley means as the fabric passes over the curved guide mandrel around the pulley means and to retain the curved guide mandrel in position around the pulley means.

2. A forward feed assembly according to claim 1 wherein the guide mandrel extends both forwardly and rearwardly beyond said endless belt drive means.

* * * * *